US011735809B2

(12) United States Patent
Wang et al.

(10) Patent No.: US 11,735,809 B2
(45) Date of Patent: Aug. 22, 2023

(54) ANTENNA SYSTEM AND TERMINAL DEVICE

(71) Applicant: Huawei Technologies Co., Ltd., Shenzhen (CN)

(72) Inventors: Hanyang Wang, Reading (GB); Lei Wang, Shanghai (CN); Yan Wang, Shenzhen (CN); Jiaqing You, Shanghai (CN); Dong Yu, Shanghai (CN); Liang Xue, Shanghai (CN); Chien-ming Lee, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 57 days.

(21) Appl. No.: 17/055,396

(22) PCT Filed: May 15, 2018

(86) PCT No.: PCT/CN2018/086932
§ 371 (c)(1),
(2) Date: Nov. 13, 2020

(87) PCT Pub. No.: WO2019/218168
PCT Pub. Date: Nov. 21, 2019

(65) Prior Publication Data

US 2021/0151886 A1 May 20, 2021

(51) Int. Cl.
*H01Q 1/24* (2006.01)
*H01Q 1/44* (2006.01)
(Continued)

(52) U.S. Cl.
CPC ..... *H01Q 1/243* (2013.01); *H01Q 1/38* (2013.01); *H01Q 1/44* (2013.01); *H01Q 1/48* (2013.01);
(Continued)

(58) Field of Classification Search
CPC ..... H01Q 1/243
See application file for complete search history.

(56) References Cited

U.S. PATENT DOCUMENTS 9,686,385 B2 6/2017 Li
10,355,339 B2 * 7/2019 Jin ..... H01Q 5/314
(Continued)

FOREIGN PATENT DOCUMENTS

CN 102255134 A 11/2011
CN 104300215 A 1/2015
(Continued)

*Primary Examiner* — Ab Salam Alkassin, Jr.
(74) *Attorney, Agent, or Firm* — Conley Rose, P.C.

(57) ABSTRACT

An antenna system and a terminal device, where the antenna system includes a first feed point, a first ground point, a second feed point, a second ground point, a third ground point, a fourth ground point, a first radiator, a second radiator, a first resonance structure, and a second resonance structure, where the first feed point is coupled to the first radiator, the second feed point is coupled to the second radiator, the first radiator is coupled to the first ground point, and the second radiator is coupled to the second ground point, the first resonance structure is electromagnetically coupled to the first radiator at a first distance from the first radiator, and the second resonance structure is electromagnetically coupled to the second radiator at a second distance from the second radiator.

20 Claims, 5 Drawing Sheets

(51) Int. Cl.

| | |
|---|---|
| ***H01Q 5/378*** | (2015.01) |
| ***H01Q 21/28*** | (2006.01) |
| ***H01Q 5/35*** | (2015.01) |
| ***H01Q 1/38*** | (2006.01) |
| ***H01Q 1/48*** | (2006.01) |
| ***H01Q 9/42*** | (2006.01) |

(52) U.S. Cl.
CPC ..... *H01Q 5/35* (2015.01); *H01Q 5/378* (2015.01); *H01Q 9/42* (2013.01); *H01Q 21/28* (2013.01)

(56) References Cited

U.S. PATENT DOCUMENTS

| | | | | |
|---|---|---|---|---|
| 10,651,542 | B2 * | 5/2020 | Choi | H01Q 21/28 |
| 10,879,589 | B2 * | 12/2020 | Lim | H01Q 13/10 |
| 11,223,106 | B2 * | 1/2022 | Khripkov | H01Q 5/35 |
| 2014/0078008 | A1 * | 3/2014 | Kang | H01Q 1/243 343/702 |
| 2014/0361941 | A1 * | 12/2014 | Jenwatanavet | H01Q 5/328 343/722 |
| 2015/0145735 | A1 | 5/2015 | Fan et al. | |
| 2015/0222020 | A1 | 8/2015 | Tai et al. | |
| 2016/0006131 | A1 | 1/2016 | Matsumura et al. | |
| 2016/0064820 | A1 * | 3/2016 | Kim | H01Q 9/045 343/767 |
| 2016/0164169 | A1 * | 6/2016 | Krogerus | H01Q 21/28 343/702 |
| 2016/0337025 | A1 | 11/2016 | Xu et al. | |
| 2016/0365623 | A1 * | 12/2016 | Kim | H01Q 9/42 |
| 2017/0207515 | A1 * | 7/2017 | Li | H04B 1/3827 |
| 2017/0264003 | A1 * | 9/2017 | Jung | H01Q 1/42 |
| 2017/0302771 | A1 * | 10/2017 | Kim | H01Q 1/243 |
| 2017/0338545 | A1 * | 11/2017 | Guo | H01Q 21/28 |
| 2017/0373388 | A1 * | 12/2017 | Wang | H01Q 1/243 |
| 2018/0026335 | A1 * | 1/2018 | Lee | H01Q 1/242 343/702 |
| 2018/0026348 | A1 | 1/2018 | Lee et al. | |
| 2018/0026353 | A1 * | 1/2018 | Tseng | H01Q 5/10 455/575.7 |
| 2018/0026355 | A1 * | 1/2018 | Lee | H01Q 1/243 343/770 |
| 2018/0069301 | A1 * | 3/2018 | Choi | H01Q 1/245 |
| 2018/0131092 | A1 * | 5/2018 | Liou | H01Q 1/243 |
| 2018/0248250 | A1 * | 8/2018 | Hsu | H01Q 9/42 |
| 2018/0261907 | A1 * | 9/2018 | Ha | H01Q 13/10 |
| 2018/0261921 | A1 * | 9/2018 | Ha | H01Q 1/243 |
| 2018/0358699 | A1 * | 12/2018 | Li | H01Q 1/521 |
| 2019/0067797 | A1 * | 2/2019 | Jung | H04M 1/026 |
| 2019/0097319 | A1 * | 3/2019 | Hsieh | H01Q 1/243 |
| 2019/0181552 | A1 * | 6/2019 | Lee | H01Q 3/247 |
| 2019/0181554 | A1 * | 6/2019 | Lee | H01Q 13/10 |
| 2019/0214714 | A1 * | 7/2019 | Chen | H01Q 5/371 |
| 2019/0237852 | A1 * | 8/2019 | Tsou | H01Q 9/0421 |
| 2019/0252764 | A1 * | 8/2019 | Liao | H01Q 5/378 |
| 2019/0252765 | A1 * | 8/2019 | Chen | H01Q 1/38 |
| 2020/0014093 | A1 * | 1/2020 | Kim | H01Q 1/243 |
| 2020/0036084 | A1 * | 1/2020 | Her | H01Q 1/48 |
| 2020/0076059 | A1 * | 3/2020 | Hsiao | H01Q 1/1207 |
| 2020/0076062 | A1 * | 3/2020 | Lee | H01Q 1/243 |
| 2020/0274229 | A1 * | 8/2020 | Choi | H01Q 9/42 |
| 2020/0373669 | A1 * | 11/2020 | Xue | H01Q 1/243 |
| 2021/0021034 | A1 * | 1/2021 | Xue | H01Q 1/52 |
| 2021/0044003 | A1 * | 2/2021 | Ma | H01Q 1/243 |
| 2021/0075089 | A1 * | 3/2021 | Chang | H04B 1/005 |
| 2021/0210839 | A1 * | 7/2021 | Hsu | H01Q 1/243 |
| 2021/0226319 | A1 * | 7/2021 | Sung | H01Q 1/44 |
| 2021/0305682 | A1 * | 9/2021 | Wang | H01Q 1/48 |
| 2021/0320392 | A1 * | 10/2021 | Hsu | H01Q 1/16 |
| 2021/0328330 | A1 * | 10/2021 | Choi | H01Q 5/364 |
| 2021/0399406 | A1 * | 12/2021 | Tsai | H01Q 5/328 |
| 2022/0037764 | A1 * | 2/2022 | Hsu | H01Q 21/30 |
| 2022/0069445 | A1 * | 3/2022 | Ha | H04M 1/0277 |
| 2022/0069468 | A1 * | 3/2022 | Hsu | H01Q 5/35 |
| 2022/0077880 | A1 * | 3/2022 | Wang | H01Q 1/241 |
| 2022/0102852 | A1 * | 3/2022 | Irci | H01Q 1/521 |
| 2022/0140471 | A1 * | 5/2022 | Sun | H01Q 1/2291 343/702 |
| 2022/0140846 | A1 * | 5/2022 | Liao | H04B 1/0064 343/702 |
| 2022/0166867 | A1 * | 5/2022 | Nam | H01Q 9/30 |
| 2022/0263243 | A1 * | 8/2022 | Sakurai | H01Q 9/42 |

FOREIGN PATENT DOCUMENTS

| | | | |
|---|---|---|---|
| CN | 104701619 | A | 6/2015 |
| CN | 104871365 | A | 8/2015 |
| CN | 105305067 | A | 2/2016 |
| CN | 105870593 | A | 8/2016 |
| CN | 106935959 | A | 7/2017 |
| CN | 107196043 | A | 9/2017 |
| CN | 107799885 | A | 3/2018 |
| CN | 112928449 | A | 6/2021 |
| EP | 2993730 | A1 | 3/2016 |
| JP | 2015533047 | A | 11/2015 |
| JP | 2016500239 | A | 1/2016 |
| KR | 20160027700 | A | 3/2016 |
| KR | 20180027802 | A | 3/2018 |
| WO | 2014051736 | A1 | 4/2014 |

* cited by examiner

ANTENNA SYSTEM AND TERMINAL DEVICE

CROSS-REFERENCE TO RELATED APPLICATIONS

This application is a U.S. National Stage of International Patent Application No. PCT/CN2018/086932 filed on May 15, 2018, which is hereby incorporated by reference in its entirety.

TECHNICAL FIELD

This application relates to the field of antenna technologies, and in particular, to an antenna system and a terminal device.

BACKGROUND

Due to rapid development of mobile phone technologies, a requirement for a rate of a mobile phone is continuously increased. Technologies such as carrier aggregation (CA) and multiple input multiple output (MIMO) are applied to a 4th generation (4G) or a 5th generation (5G) communications technology to improve the rate. This requires the mobile phone to have a plurality of antennas. In the 5G communications technology, a New Radio (NR) frequency band is added. To be specific, N77, N78, and N79 include a high frequency part of 3.3 gigahertz (GHz) to 5 GHz. This requires that an antenna of the mobile phone can support a higher frequency band. In addition, to implement a high screen-to-body ratio of the mobile phone, an antenna size needs to be continuously reduced.

In general, the foregoing requirements make it increasingly difficult to design the antenna of the mobile phone.

SUMMARY

Embodiments of this application provide an antenna system and a terminal device, to support low-frequency dual CA and an NR frequency band.

To achieve the foregoing objective, the following technical solutions are used in the embodiments of this application.

According to a first aspect, an antenna system is provided, including: a first feed point, a first ground point, a second feed point, a second ground point, a third ground point, a fourth ground point, a first radiator, a second radiator, a first resonance structure, and a second resonance structure. The first ground point, the second ground point, the third ground point, and the fourth ground point are located on a mainboard ground. The first feed point is connected to the first radiator, and the first feed point is configured to transmit a high frequency signal and a first low frequency signal to the first radiator. The second feed point is connected to the second radiator, and the second feed point is configured to transmit an intermediate frequency signal and a second low frequency signal to the second radiator. The first radiator is connected to the first ground point, and the second radiator is connected to the second ground point. A frequency of the second low frequency signal is greater than a frequency of the first low frequency signal. The first resonance structure is electromagnetically coupled to the first radiator at a specific distance from the first radiator, and the second resonance structure is electromagnetically coupled to the second radiator at a specific distance from the second radiator. The first resonance structure is connected to the third ground point, and the second resonance structure is connected to the fourth ground point. The antenna system provided in this application is a dual-feed antenna. The resonance structure enables a single antenna to cover a low frequency, and the dual-antenna resonance structure can implement low-frequency dual CA. In addition, radiators of the two antennas can cover a long term evolution (long term evolution, LTE) frequency band, thereby supporting low-frequency dual CA.

In a possible implementation, the high frequency signal includes a new radio NR frequency band. In this implementation, the antenna system supports the NR frequency band.

In a possible implementation, the first radiator includes a first part of a lower frame of a terminal device, the second radiator includes a second part of the lower frame of the terminal device, and the first part and the second part are insulated; the first resonance structure includes a part or all of a side frame of the terminal device on a side of the first radiator, and the first resonance structure is not insulated from the first part; and the second resonance structure includes a part or all of a side frame of the terminal device on a side of the second radiator, and the second resonance structure is not insulated from the second part. In this design, the frame of the terminal device is used as a radiator and a resonance structure of the antenna system, thereby saving space inside the terminal device.

In a possible implementation, the terminal device further includes a metal screen panel, in a horizontal direction to a plane of the terminal device, a distance between the lower frame and the metal screen panel is D, a distance between the side frame and the metal screen panel is S, D is less than a first threshold, and S is less than a second threshold. This implementation can ensure a specific antenna clearance area.

In a possible implementation, in a vertical direction to the plane of the terminal device, a distance between the metal screen panel and the lower frame or the side frame is H, and H is less than a third threshold. In this implementation, regardless of values of D and S (even 0 mm), a specific antenna clearance area can still be ensured.

In a possible implementation, if D or H is less than or equal to 0, H is greater than 0. This implementation can ensure a specific antenna clearance area.

In a possible implementation, the antenna system further includes a fifth ground point, the fifth ground point is located on the mainboard ground, and the first resonance structure is connected to the fifth ground point by using a first device; and/or the antenna system further includes a sixth ground point, the sixth ground point is located on the mainboard ground, and the second resonance structure is connected to the sixth ground point by using a second device. The first device or the second device includes at least one of a filter, a switch, a zero-ohm resistor, a capacitor, and an inductor. Different effects may be implemented when the first device or the second device is different. For example, if the first device or the second device is the filter, a new low frequency may be generated by a corresponding resonance structure. If the first device or the second device is an open switch, a corresponding radiator may be in a single low frequency state. If the first device or the second device is a closed switch, the zero-ohm resistor, or the capacitor, a corresponding radiator may be in a single high frequency state.

In a possible implementation, the first feed point is connected to the first radiator by using a third device; and/or the second feed point is connected to the second radiator by using a fourth device. The third device or the fourth device includes at least one of a matching network, an adjustable capacitor, and a switch. Different effects may be implemented when the third device or the fourth device is different. For example, if the third device or the fourth device is the matching network or the adjustable capacitor, an impedance characteristic of an antenna may be improved, and output power of the antenna may be increased. If the third device or the fourth device is the switch, when the switch is turned off, a corresponding radiator is in a passive state and is used as a resonance structure of a side radiator, thereby improving efficiency of the side radiator.

In a possible implementation, the first feed point, the first ground point, and the first radiator form an inverted F antenna or a composite right/left-handed transmission line CRLH antenna; and/or the second feed point, the second ground point, and the second radiator form an inverted F antenna or a CRLH antenna. This implementation provides a possible implementation of a first antenna and a second antenna.

According to a second aspect, a terminal device is provided, including the antenna system according to any one of the first aspect and the implementations of the first aspect. For technical effects of this part, refer to technical effects of the first aspect and any implementation of the first aspect.

DESCRIPTION OF EMBODIMENTS

In descriptions of this application, it may be understood that a direction or a position relationship indicated by terms such as "center", "upper", "lower", "front", "back", "left", "right", "vertical", "horizontal", "top", "bottom", "inside", or "outside" is a direction or a position relationship shown based on the accompanying drawings, is merely used to facilitate descriptions of content of the embodiments of this application and simplify the descriptions, but is not intended to indicate or imply that an indicated apparatus or element needs to have a particular direction, and needs to be constructed and operated in a particular direction, and therefore cannot be construed as a limitation on this application.

Figure 1:
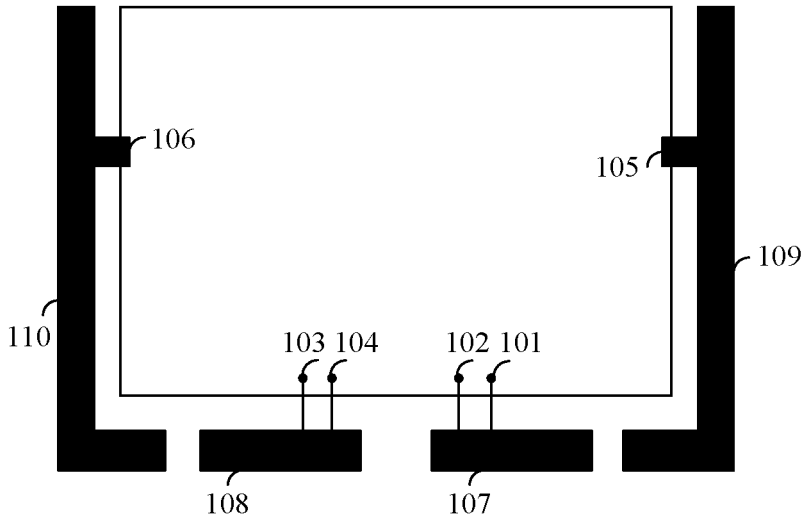
FIG. 1 is a schematic structural diagram 1 of an antenna system according to an embodiment of this application.

Referring to FIG. 1, this application provides an antenna system. The system includes a first feed point 101, a first ground point 102, a second feed point 103, a second ground point 104, a third ground point 105, a fourth ground point 106, a first radiator 107, a second radiator 108, a first resonance structure 109, and a second resonance structure 110.

The first ground point 102, the second ground point 104, the third ground point 105, and the fourth ground point 106 are located on a mainboard ground. The mainboard ground refers to a ground layer of a mainboard or a printed circuit board (PCB) on which a radio frequency device is located.

The first feed point 101 is connected to the first radiator 107, and the first feed point 101 is configured to transmit a high frequency signal and a first low frequency signal to the first radiator 107. The second feed point 103 is connected to the second radiator 108, and the second feed point 103 is configured to transmit an intermediate frequency signal and a second low frequency signal to the second radiator 108. The first radiator 107 is connected to the first ground point 102, and the second radiator 108 is connected to the second ground point 104. A frequency of the second low frequency signal is greater than a frequency of the first low frequency signal. Specifically, the frequency of the first low frequency signal may include 700 MHz to N MHz, and the frequency of the second low frequency signal may include N MHz to 960 MHz, where N represents a frequency between 700 MHz and 960 MHz. A frequency of the intermediate frequency signal may include 1710 MHz to 2400 MHz, and a frequency of the high frequency signal may include 2500 MHz to 2690 MHz. In other words, the high frequency signal includes an NR frequency band. Alternatively, in an embodiment of the present invention, specific frequencies of the high frequency signal, the intermediate frequency signal, and the low frequency signal are not limited, provided that a frequency of the high frequency signal is higher than a frequency of the intermediate frequency signal, and the frequency of the intermediate frequency signal is higher than a frequency of the low frequency signal.

The first resonance structure 109 is electromagnetically coupled to the first radiator 107 at a specific distance from the first radiator 107, and the second resonance structure 110 is electromagnetically coupled to the second radiator 108 at a specific distance from the second radiator 108. The first resonance structure 109 is connected to the third ground point 105, and the second resonance structure 110 is connected to the fourth ground point 106. The first resonance structure 109 and the first radiator 107 are used as a first antenna, and the second resonance structure 110 and the second radiator 108 are used as a second antenna.

Both the first radiator 107 of the first antenna and the second radiator 108 of the second antenna are monopoles, and resonance bandwidths of the first radiator 107 and the second radiator 108 are relatively narrow and concentrate in a high frequency or an intermediate frequency. Coupled feeding is performed on resonance structures of the first radiator 107 and the second radiator 108, to generate low-frequency resonance in the resonance structures, so that both the first antenna and the second antenna can cover a low frequency. In other words, the first antenna and the second antenna can support low-frequency dual CA.

Figure 2:
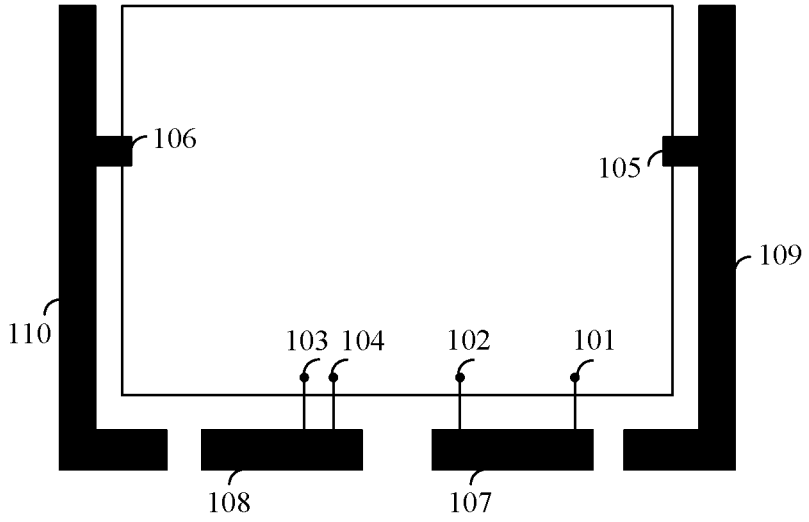
FIG. 2 is a schematic structural diagram 2 of an antenna system according to an embodiment of this application.

A form of an antenna including the first feed point 101, the first ground point 102, and the first radiator 107 is not limited in this application, and a form of an antenna including the second feed point 103, the second ground point 104, and the second radiator 108 is not limited. For example, the first feed point 101, the first ground point 102, and the first radiator 107 may form an inverted F antenna (IFA), a composite right/left-handed transmission line (CRLH) antenna, or an antenna in another form; and/or the second feed point 103, the second ground point 104, and the second radiator 108 may form an IFA antenna, a CRLH antenna, or an antenna in another form. For example, as shown in FIG. 1, the first feed point 101, the first ground point 102, and the first radiator 107 form an inverted F antenna, and the second feed point 103, the second ground point 104, and the second radiator 108 form an inverted F antenna. As shown in FIG. 2, the first feed point 101, the first ground point 102, and the first radiator 107 form an inverted F antenna, and the second feed point 103, the second ground point 104, and the second radiator 108 form a CRLH antenna.

Figure 3:
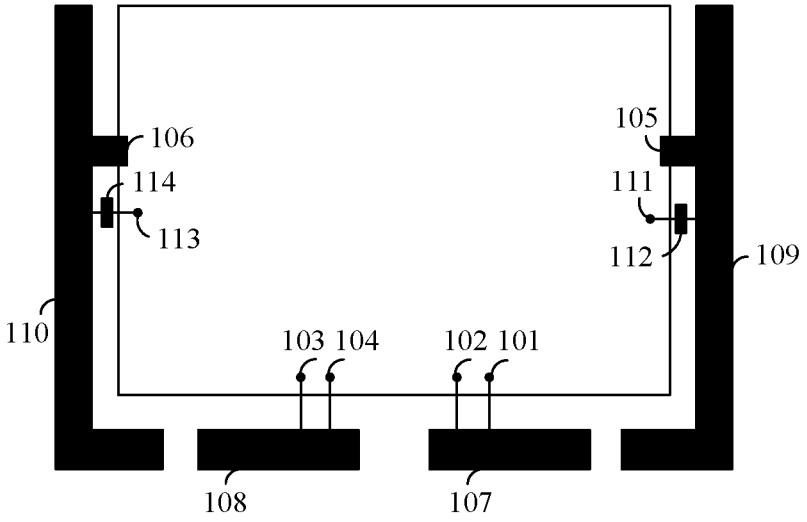
FIG. 3 is a schematic structural diagram 3 of an antenna system according to an embodiment of this application.

Referring to FIG. 3, optionally, the antenna system may further include a fifth ground point 111, where the fifth ground point 111 is connected to the mainboard ground, and the first resonance structure 109 is connected to the fifth ground point 111 by using a first device 112. Optionally, the antenna system may further include a sixth ground point 113, where the sixth ground point 113 is connected to the mainboard ground, and the second resonance structure 110 is connected to the sixth ground point 113 by using a second device 114. The first device 112 or the second device 114 includes at least one of a filter, a switch, a zero-ohm resistor, a capacitor, and an inductor.

The following uses a function of the second device 114 for the antenna system as an example for description. It may be understood that the first device 112 has the same effect for the antenna system, and details are not described herein.

For example, in addition to the low-frequency resonance generated through resonance of the second resonance structure 110 and the first radiator 107, if the second device 114 is the filter, the second resonance structure 110 may generate new low-frequency resonance to cover more low-frequency bands, thereby implementing low-frequency dual CA. If the second device 114 is the switch, when the switch is switched on, the second radiator 108 is in a single high-frequency state, and when the switch is off, the second radiator 108 is in a single low-frequency state. Both states are not affected by the filter, so that efficiency is higher. If the second device 114 is the zero-ohm resistor, a small capacitor, or a small inductor, the second radiator 108 is in a single high frequency state.

Figure 4:
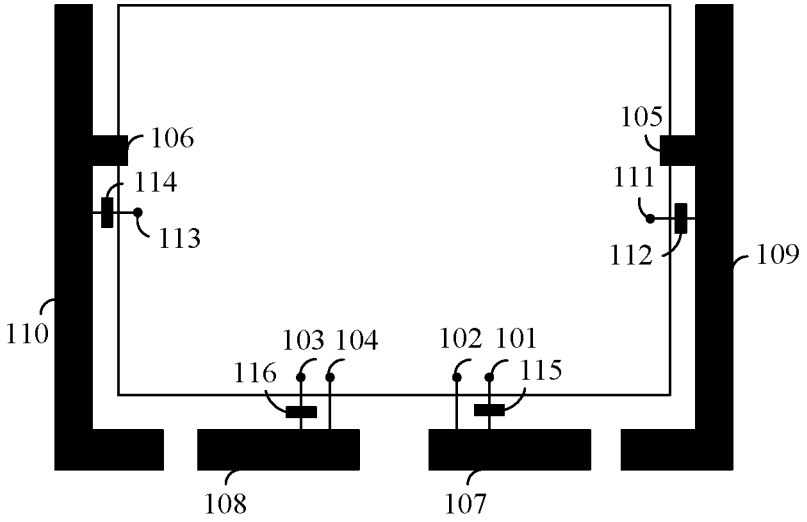
FIG. 4 is a schematic structural diagram 4 of an antenna system according to an embodiment of this application.

Referring to FIG. 4, optionally, the first feed point 101 may be connected to the first radiator 107 by using a third device 115. Optionally, the second feed point 103 may be connected to the second radiator 108 by using a fourth device 116. The third device 115 or the fourth device 116 includes at least one of a matching network, an adjustable capacitor, and a switch. The following describes functions of the matching network, the adjustable capacitor, and the switch for the antenna system.

From a perspective of impedance, in a radio signal transmission process, if transmit electrical characteristics (impedance characteristics, and the like) of a transmitter or a forwarding apparatus (for example, an apparatus for sending a television, a broadcast station, radio communication, or a mobile phone signal) match each other, a loss and distortion of radio signal transmission may be minimized. Therefore, a network having the same electrical characteristic as an antenna is referred to as the matching network. Quality of the matching network directly affects a standing wave ratio (standing wave ratio, SWR) of the antenna and efficiency of the antenna. A matching network or an adjustable capacitor connected between a feed point and a radiator may be used to improve an impedance characteristic of an antenna and increase an output power of the antenna.

When a switch connected between the feed point and the radiator is switched on, content is consistent with that in FIG. 1 to FIG. 3, and details are not described. When the switch connected between the feed point and the radiator is off, a corresponding radiator is in a passive state. For example, if a switch between the second feed point 103 and the second radiator 108 is off, the second radiator 108 is in a passive state (that is, a non-CA state), and the second radiator 108 and the second resonance structure 110 become a resonance structure of the first radiator 107, so that efficiency of the first radiator 107 can be improved. Alternatively, if a switch between the first feed point 101 and the first radiator 107 is off, the first radiator 107 is in a passive state, and the first radiator 107 and the first resonance structure 109 become a resonance structure of the second radiator 108, so that efficiency of the second radiator 108 can be improved. In the non-CA scenario, a length of the resonance structure may be shortened, so that an antenna bandwidth is narrowed, thereby ensuring performance of a single frequency band.

If the antenna system is installed on an upper part of the terminal device such as a mobile phone, because a head of a person is relatively close to the upper part of the terminal device during a call, a specific absorption rate (specific absorption rate, SAR) of the entire antenna system is excessively high, and efficiency of the antenna system is reduced. Therefore, the antenna system is preferably installed on a lower part of the terminal device. An SAR is an electromagnetic wave energy absorption rate of a mobile phone or a wireless product. Because various organs of a human body are lossy media, an induced electromagnetic field is generated in the human body under an action of an external electromagnetic field, and the induced electromagnetic field generates a current to absorb and dissipate electromagnetic energy.

If the antenna system is installed in the terminal device, to save space inside the terminal device to further improve a screen-to-body ratio, frames of the terminal device may be designed as the first radiator 107, the second radiator 108, the first resonance structure 109, and the second resonance structure 110. In particular, a lower frame of the terminal device may be designed as the first radiator 107 and the second radiator 108, and a side frame of the terminal device may be designed as the first resonance structure 109 and the second resonance structure 110.

Figure 5:
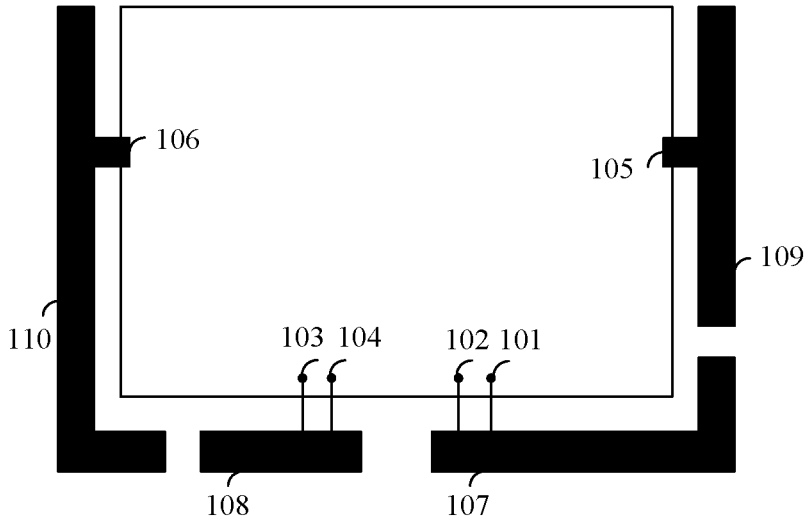
FIG. 5 is a schematic structural diagram 5 of an antenna system according to an embodiment of this application.

The first radiator 107 may include a first part of the lower frame of the terminal device, the second radiator 108 may include a second part of the lower frame of the terminal device, and the first part and the second part are not insulated. The first resonance structure 109 may include a part or all of a side frame of the terminal device on a side of the first radiator 107, and is not insulated from the first part. The second resonance structure 110 may include a part or all of a side frame of the terminal device on a side of the second radiator 108, and is not insulated from the second part. A slot is located between the radiators or between the radiator and the resonance structure, and the slot may be filled with a non-metallic object, or another device that is not in electrical contact with the radiator or the resonance structure is installed in the slot, for example, a Universal Serial Bus (USB) interface. As shown in FIG. 1, the first resonance structure 109 and/or the second resonance structure 110 may further separately include a part of the lower frame of the terminal device. As shown in FIG. 5, the first radiator 107 and/or the second radiator 108 may further separately include a part of a side frame of the terminal device.

Figure 6:
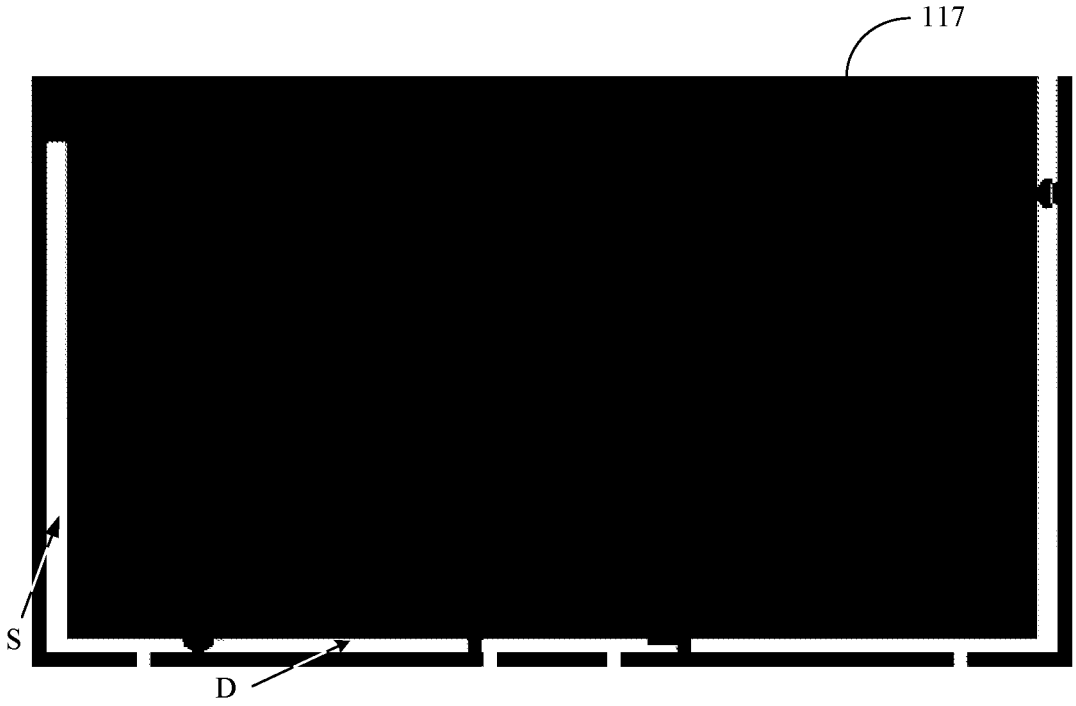
FIG. 6 is a schematic diagram 1 of an antenna clearance area of an antenna system according to an embodiment of this application.
Figure 7:
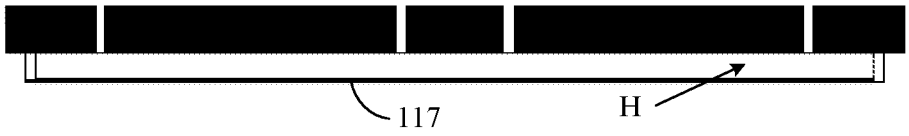
FIG. 7 is a schematic diagram 2 of an antenna clearance area of an antenna system according to an embodiment of this application.

Because the antenna in this application may use the frames of the terminal device, an antenna clearance area may be very small. The antenna clearance area indicates a size of an area in which the antenna is not grounded. When an antenna element is too close to the ground, capacitance to the ground increases, which affects antenna matching. As shown in FIG. 6, to enhance strength of the terminal device, a metal screen panel 117 is usually disposed inside a housing. This is equivalent to that in a horizontal direction to a plane of the terminal device, a distance between the lower frame and the metal screen panel 117 is D, and a distance between the side frame and the metal screen panel 117 is S, where D is less than a first threshold, S is less than a second threshold, and D and S may be less than or equal to 3 mm, or may even be negative values. Optionally, as shown in FIG. 7, in a vertical direction to the plane of the terminal device, there may be a specific distance H between the metal screen panel 117 and the lower frame or the side frame of the terminal device, where H is less than a third threshold. If D or S is less than or equal to 0, H may be greater than 0. If D and S are both greater than 0, H may be less than or equal to 0 or may be greater than 0. The distance H can ensure a specific antenna clearance area. Values of D, S, and H are not limited in this application.

Figure 8:
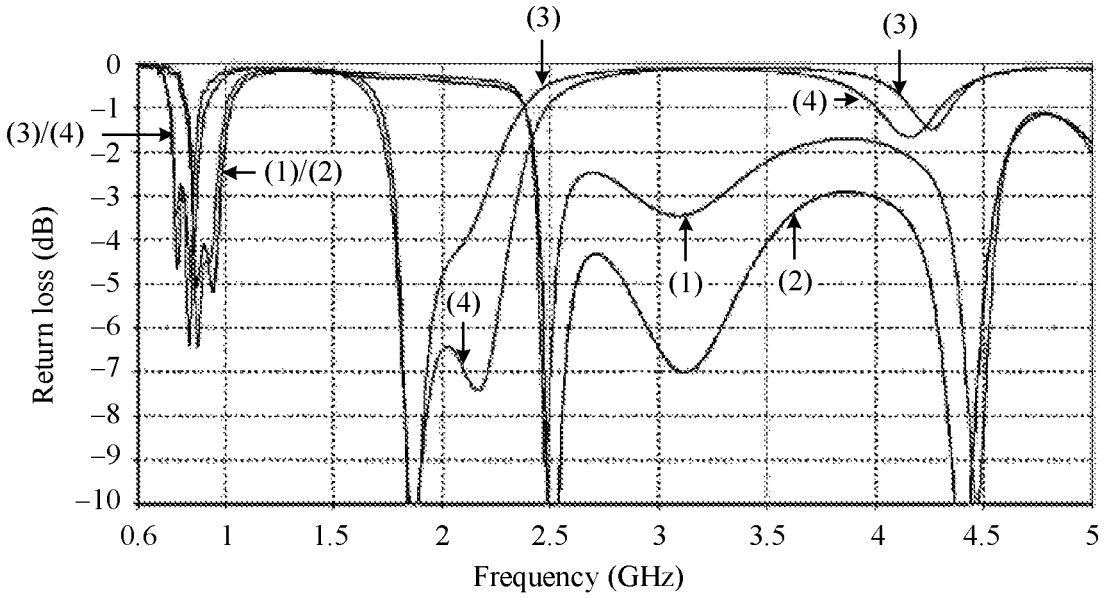
FIG. 8 is a schematic diagram 1 of a return loss of an antenna system according to an embodiment of this application.

FIG. 8 is a schematic diagram of return losses of a first antenna and a second antenna with different D when S=1.5 mm. The return loss is also called reflection loss, is reflection caused by antenna impedance mismatch. The impedance mismatch mainly occurs at a connection point or a point at which impedance changes. The return loss causes signal fluctuation. A returned signal is considered as a received signal by mistake, which causes confusion. Curve (1) shows a return loss of the first antenna when D=0 mm, Curve (2) shows a return loss of the first antenna when D=2 mm, Curve (3) shows a return loss of the second antenna when D=0 mm, and Curve (4) shows a return loss of the second antenna when D=2 mm. A frequency with a return loss less than −3 dB is an available frequency. It can be learned from the figure that frequencies near 2.5 GHz, 4.5 GHz, and N MHz to 900 MHz are available for the first antenna, and frequencies near 700 MHz to N MHz and 1.8 GHz are available for the second antenna.

Figure 9:
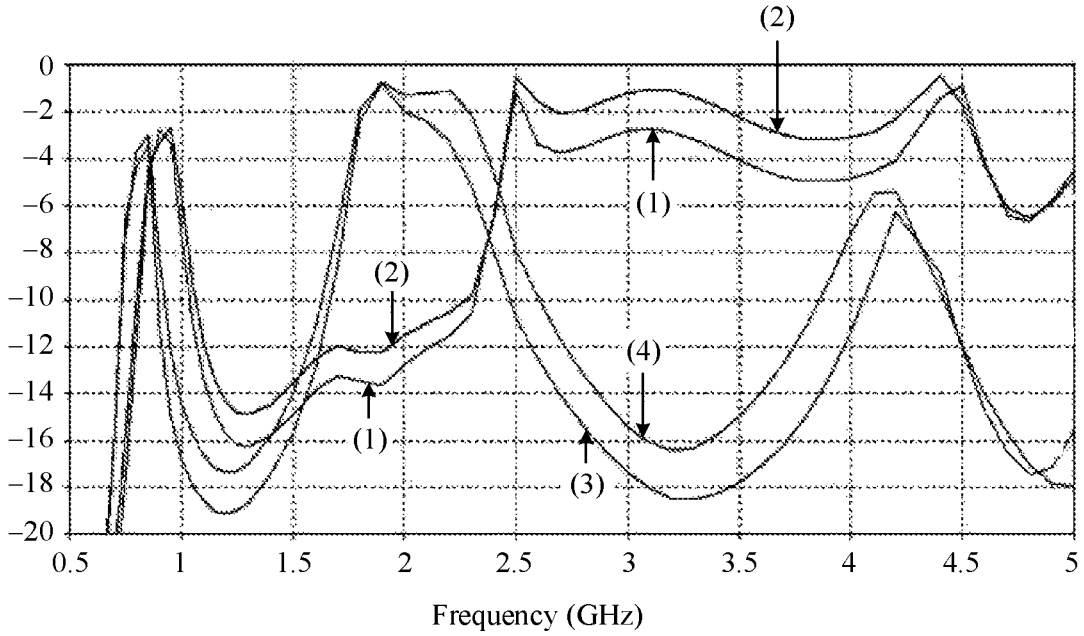
FIG. 9 is a schematic diagram 1 of antenna efficiency of an antenna system according to an embodiment of this application.

FIG. 9 is a schematic diagram of antenna efficiency of a first antenna and a second antenna with different D when S=1.5 mm. Antenna efficiency is a ratio of a power radiated by an antenna (that is, a power effectively converted to electromagnetic waves) to an active power input to the antenna. Curve (1) shows antenna efficiency of the first antenna when D=0 mm, Curve (2) shows antenna efficiency of the first antenna when D=2 mm, Curve (3) shows antenna efficiency of the second antenna when D=0 mm, and Curve (4) shows antenna efficiency of the second antenna when D=2 mm. It can be learned from the figure that, antenna efficiency of the first antenna at frequencies near 2.5 GHz, 4.5 GHz, and N MHz to 900 MHz is relatively high, and antenna efficiency of the second antenna at frequencies near 700 MHz to N MHz and 1.8 GHz is relatively high.

Figure 10:
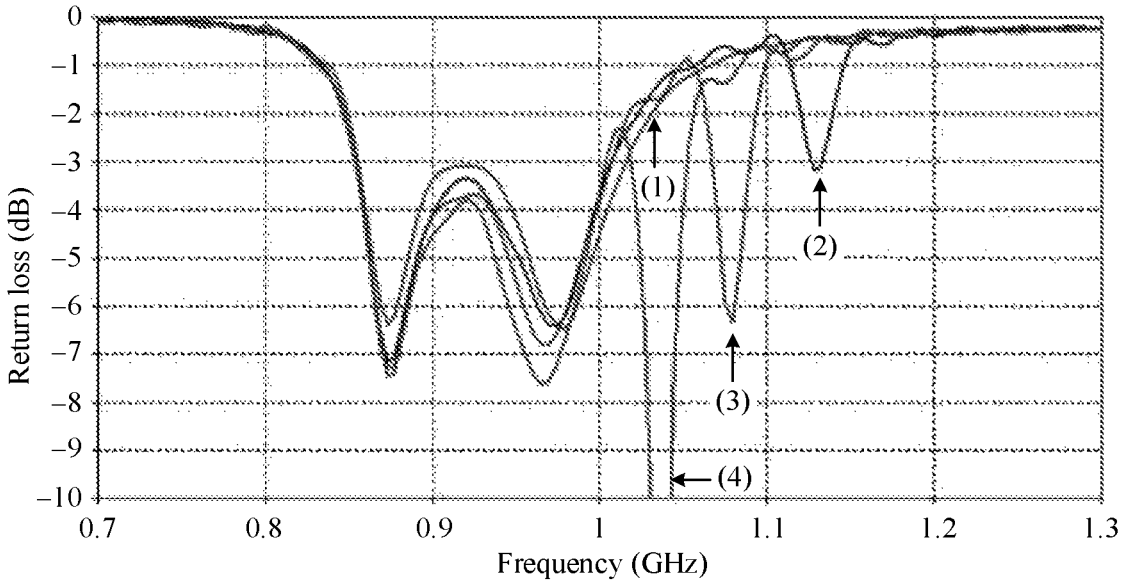
FIG. 10 is a schematic diagram 2 of a return loss of an antenna system according to an embodiment of this application.

If D=2 mm, S=1.5 mm, the switch between the first feed point 101 and the first radiator 107 is off, the first radiator 107 and the first resonance structure 109 become the resonance structure of the second radiator 108 (a non-CA state in this case), and the fourth device 116 is a matching network, return losses obtained when the matching network is different inductors are shown in FIG. 10. Curve (1) shows a return loss in a CA state, Curve (2) shows a return loss in the non-CA state when the fourth device 116 is a 14-nH inductor, Curve (3) shows a return loss in the non-CA state when the fourth device 116 is a 16-nH inductor, and Curve (4) shows a return loss in the non-CA state when the fourth device 116 is an 18-nH inductor. A minimum value at an arrow in the figure is a decrease in a return loss caused by resonance of the first radiator 107 and the first resonance structure 109.

Figure 11:
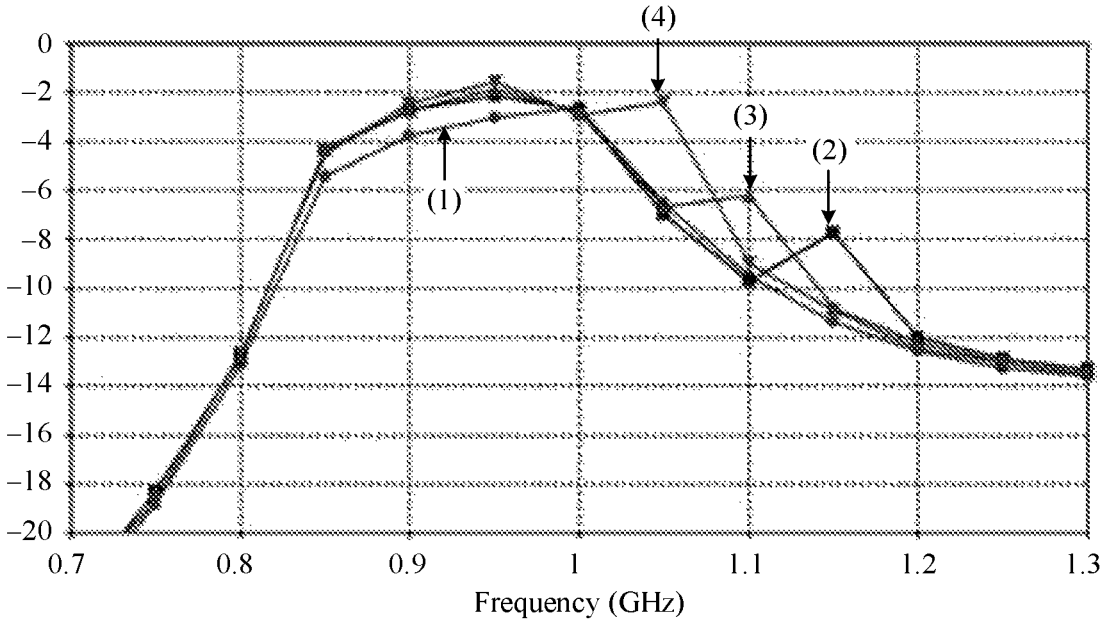
FIG. 11 is a schematic diagram 2 of antenna efficiency of an antenna system according to an embodiment of this application.

FIG. 11 is a schematic diagram of antenna efficiency when the fourth device 116 is a matching network and the matching network is different inductors under the same conditions as those in FIG. 10. Curve (1) shows antenna efficiency in a CA state, Curve (2) shows antenna efficiency in the non-CA state when the fourth device 116 is a 14-nH inductor, Curve (3) shows antenna efficiency in the non-CA state when the fourth device 116 is a 16-nH inductor, and Curve (4) shows antenna efficiency in the non-CA state when the fourth device 116 is an 18-nH inductor. A minimum value at an arrow in the figure is an increase in the antenna efficiency caused by resonance of the first radiator 107 and the first resonance structure 109.

The antenna system provided in this application is a dual-feed antenna. The resonance structure enables a single antenna to cover a low frequency, and the dual-antenna resonance structure can implement low-frequency dual CA. In addition, radiators of the two antennas can cover a long term evolution (long term evolution, LTE) frequency band and a newly added NR frequency band, thereby supporting both the low-frequency dual CA and the NR frequency band.

A person of ordinary skill in the art may be aware that, in combination with the examples described in the embodiments disclosed in this specification, units and algorithm steps may be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of this application.

What is claimed is:

1. An antenna system, comprising:

a mainboard ground;

a first ground point located on the mainboard ground;

a first radiator coupled to the first ground point and comprising a first part of a lower frame of a terminal device;

a first feed point coupled to the first radiator and configured to transmit a high frequency signal and a first low frequency signal to the first radiator, wherein the first low frequency signal comprises a first frequency;

a second ground point located on the mainboard ground;

a second radiator coupled to the second ground point and comprising a second part of the lower frame;

a second feed point coupled to the second radiator and configured to transmit an intermediate frequency signal and a second low frequency signal to the second radiator, wherein the second low frequency signal comprises a second frequency, and wherein the second frequency is greater than the first frequency;

a third ground point located on the mainboard ground;

a first resonance structure electromagnetically coupled to the first radiator via a first slot located between the first resonance structure and the first radiator, to radiate the first low frequency signal, wherein the first resonance structure is further coupled to the third ground point and comprising a part of a first side frame of the terminal device;

a fourth ground point located on the mainboard ground; and a second resonance structure electromagnetically coupled to the second radiator via a second slot located between the second resonance structure and the second radiator, to radiate the second low frequency signal, wherein the second resonance structure is further coupled to the fourth ground point and comprising a part of a second side frame of the terminal device, wherein a third slot is located between the first part and the second part, and wherein at least one of the first slot and the second slot is located on the lower frame.

2. The antenna system of claim 1, wherein the high frequency signal comprises a New Radio (NR) frequency band.

3. The antenna system of claim 1, wherein the terminal device further comprises a metal screen panel located in a horizontal direction to a plane of the terminal device, wherein a first distance between the lower frame and the metal screen panel is D, wherein a second distance between the side frame and the metal screen panel is S, wherein D is less than a first threshold, and wherein S is less than a second threshold.

4. The antenna system of claim 3, wherein in a vertical direction to the plane, a third distance between the metal screen panel and the lower frame is H, wherein in the vertical direction to the plane, a fourth distance between the metal screen panel and the side frame is H, and wherein H is less than a third threshold.

5. The antenna system of claim 4, wherein H is greater than zero when D or S is less than or equal to zero.

6. The antenna system of claim 5, further comprising a fifth ground point located on the mainboard ground, wherein the first resonance structure is coupled to the fifth ground point using at least one of a filter, a switch, a zero-ohm resistor, a capacitor, or an inductor.

7. The antenna system of claim 6, wherein the first feed point is further coupled to the first radiator using at least one of a matching network, an adjustable capacitor, or a switch.

8. The antenna system of claim 6, further comprising a sixth ground point located on the mainboard ground, wherein the second resonance structure is coupled to the sixth ground point using at least one of a filter, a switch, a zero-ohm resistor, a capacitor, or an inductor.

9. The antenna system of claim 8, wherein the second feed point is further coupled to the second radiator using at least one of a matching network, an adjustable capacitor, or a switch.

10. A terminal device, comprising:

an antenna system comprising:

a mainboard ground;

a first ground point located on the mainboard ground;

a first radiator coupled to the first ground point and comprising a first part of a lower frame of a terminal device;

a first feed point coupled to the first radiator and configured to transmit a high frequency signal and a first low frequency signal to the first radiator, wherein the first low frequency signal comprises a first frequency;

a second ground point located on the mainboard ground;

a second radiator coupled to the second ground point and comprising a second part of the lower frame;

a second feed point coupled to the second radiator and configured to transmit an intermediate frequency signal and a second low frequency signal to the second radiator, wherein the second low frequency signal comprises a second frequency, and wherein the second frequency is greater than the first frequency;

a third ground point located on the mainboard ground;

a first resonance structure electromagnetically coupled to the first radiator via a first slot located between the first resonance structure and the first radiator, to radiate the first low frequency signal, wherein the first resonance structure is further coupled to the third ground point and comprising a part of a first side frame of the terminal device;

a fourth ground point located on the mainboard ground; and a second resonance structure electromagnetically coupled to the second radiator via a second slot located between the second resonance structure and the second radiator, to radiate the second low frequency signal, wherein the second resonance structure is further coupled to the fourth ground point and comprising a part of a second side frame of the terminal device, wherein a third slot is located between the first part and the second part, and wherein at least one of the first slot and the second slot is located on the lower frame.

11. The terminal device of claim 10, wherein the high frequency signal comprises a New Radio (NR) frequency band.

12. The terminal device of claim 10, further comprising a metal screen panel located in a horizontal direction to a plane of the terminal device, wherein a first distance between the lower frame and the metal screen panel is D, wherein a second distance between the side frame and the metal screen panel is S, wherein D is less than a first threshold, and wherein S is less than a second threshold.

13. The terminal device of claim 12, wherein in a vertical direction to the plane, a third distance between the metal screen panel and the lower frame is H, wherein in the vertical direction to the plane, a fourth distance between the metal screen panel and the side frame is H, and wherein H is less than a third threshold.

14. The terminal device of claim 13, wherein H is greater than zero when D or S is less than or equal to zero.

15. The terminal device of claim 14, further comprising a fifth ground point located on the mainboard ground, wherein the first resonance structure is coupled to the fifth ground point using at least one of a filter, a switch, a zero-ohm resistor, a capacitor, or an inductor.

16. The terminal device of claim 15, wherein the first feed point is further coupled to the first radiator using at least one of a matching network, an adjustable capacitor, or a switch.

17. The terminal device of claim 15, further comprising a sixth ground point located on the mainboard ground, wherein the second resonance structure is coupled to the sixth ground point using at least one of a filter, a switch, a zero-ohm resistor, a capacitor, or an inductor.

18. The terminal device of claim 17, wherein the second feed point is further coupled to the second radiator using at least one of a matching network, an adjustable capacitor, or a switch.

19. An antenna system, comprising:

a mainboard ground;

a first ground point located on the mainboard ground;

a first radiator coupled to the first ground point and comprising a first part of a lower frame of a terminal device;

a first feed point coupled to the first radiator and configured to transmit a high frequency signal and a first low frequency signal to the first radiator, wherein the first low frequency signal comprises a first frequency;

a second ground point located on the mainboard ground;

a second radiator coupled to the second ground point and comprising a second part of the lower frame;

a second feed point coupled to the second radiator and configured to transmit an intermediate frequency signal and a second low frequency signal to the second radiator, wherein the second low frequency signal comprises a second frequency, and wherein the second frequency is greater than the first frequency;

a third ground point located on the mainboard ground;

a first resonance structure electromagnetically coupled to the first radiator via a first slot located between the first resonance structure and the first radiator, to radiate the first low frequency signal, wherein the first resonance structure is further coupled to the third ground point and comprising a part of a first side frame of the terminal device;

a fourth ground point located on the mainboard ground; and a second resonance structure electromagnetically coupled to the second radiator via a second slot located between the second resonance structure and the second radiator, to radiate the second low frequency signal, wherein the second resonance structure is further coupled to the fourth ground point and comprising a part of a second side frame of the terminal device, wherein a third slot is located between the first part and the second part, wherein at least one of the first slot and the second slot is located on the lower frame, and wherein the high frequency signal comprises a New Radio (NR) frequency band.

20. The antenna system of claim 19, wherein the terminal device further comprises a metal screen panel located in a horizontal direction to a plane of the terminal device, wherein a first distance between the lower frame and the metal screen panel is D, wherein a second distance between the side frame and the metal screen panel is S, wherein D is less than a first threshold, wherein S is less than a second threshold, wherein in a vertical direction to the plane, a third distance between the metal screen panel and the lower frame is H, wherein in the vertical direction to the plane, a fourth distance between the metal screen panel and the side frame is H, wherein H is less than a third threshold, and wherein H is greater than zero when D or S is less than or equal to zero.

* * * * *